United States Patent [19]

Wakino et al.

[11] Patent Number: 4,692,727

[45] Date of Patent: Sep. 8, 1987

[54] DIELECTRIC RESONATOR DEVICE

[75] Inventors: Kikuo Wakino, Muko; Hiroshi Tamura; Youhei Ishikawa, both of Kyoto, all of Japan

[73] Assignee: Murata Manufacturing Co., Ltd., Japan

[21] Appl. No.: 870,088

[22] Filed: Jun. 3, 1986

[30] Foreign Application Priority Data

Jun. 5, 1985 [JP] Japan ..... 60-123136

[51] Int. Cl.[4] ..... H01P 7/10

[52] U.S. Cl. ..... 333/219; 333/202; 333/209; 333/232; 333/235

[58] Field of Search ..... 333/219, 202, 229, 231, 333/232, 233, 235, 208–212, 245, 248, 205, 207; 310/328–333; 331/96, 107 DP

[56] References Cited

U.S. PATENT DOCUMENTS 4,575,697 3/1986 Rao et al. ..... 333/248 X

FOREIGN PATENT DOCUMENTS 0000102 1/1984 Japan ..... 333/202

0226503 12/1984 Japan ..... 333/202

*Primary Examiner*—Marvin L. Nussbaum

*Attorney, Agent, or Firm*—Ostrolenk, Faber, Gerb & Soffen

[57] ABSTRACT

A dielectric resonator device includes a casing for defining a chamber in which a dielectric resonator and a piezoelectric frequency adjusting unit are provided. A portion of the piezoelectric frequency adjusting unit is located adjacent the dielectric resonator. By the voltage applied to the piezoelectric frequency adjusting unit, the piezoelectric frequency adjusting unit changes its shape thereby changing the distance between the portion of the piezoelectric frequency adjusting unit and the dielectric resonator. Thus, the resonance frequency of the dielectric device can be controlled.

7 Claims, 8 Drawing Figures

DIELECTRIC RESONATOR DEVICE

BACKGROUND OF THE INVENTION

1. Field of the Invention

The present invention relates to a dielectric resonator device and, more particularly, to an improved dielectric resonator device which has an adjusting arrangement to adjust the resonance frequency.

2. Description of the Prior Art

Various types of dielectric resonator devices have been developed. One prior art dielectric resonator device has a resonance frequency adjustment mechanism which operates in the $TE_{01\delta}$ resonance mode, such as disclosed in Japanese Utility Model Laid-Open publication No. 54-98141. According to this reference, a dielectric resonator and metal screw as a frequency adjustment means are mounted in a casing. The metal screw moves towards or away from the dielectric resonator to adjust the resonance frequency. This frequency adjustment mechanism is applied not only to a dielectric resonator operated in $TE_{01\delta}$ resonance mode, but also to dielectric resonators operated in TEM, $TM_{110}$, and $TM_{010}$ resonance modes.

Conventionally, no voltage-controlled oscillator (this is abbreviated as VCO) has been developed which employs the above described resonance frequency adjustment mechanism, wherein the frequency adjustment mechanism moves towards or away from the dielectric resonator to adjust the resonance frequency.

SUMMARY OF THE INVENTION

The present invention has been developed to provide an improved dielectric resonator device which may adjust resonance frequency by the control of a voltage.

It is another object of the present invention to provide an improved dielectric resonator device of the above described type which can readily be manufactured at low cost.

In accomplishing these and other objects, an improved dielectric resonator device according to the present invention comprises a piezoelectric frequency adjusting unit provided adjacent a dielectric resonator fixedly installed in a casing. The piezoelectric frequency adjusting unit according to one embodiment is defined by an elongated piezoelectric unit which bends in response to the voltage applied thereto. The elongated piezoelectric unit has one end connected to the casing and the other end (free end) located adjacent the dielectric resonator so as to moves the free end towards or away from the dielectric resonator, whereby the resonance frequency of the dielectric resonator increases or decreases when the free end of the elongated piezoelectric unit moves towards or away from the dielectric resonator, respectively.

In another embodiment, another dielectric resonator is attached to the free end of the elongated piezoelectric unit so that the another dielectric resonator moves, relatively to the voltage applied to the elongated piezoelectric unit, towards or away from the dielectric resonator mounted in a casing. As a result, the resonance frequency in $TE_{01\delta}$ even-mode changes.

In a further embodiment, the piezoelectric frequency adjusting unit is defined by a piezoelectric body having one end fixedly connected to the casing and the other end located adjacent the dielectric resonator so as to moves the other end thereof towards or away from the dielectric resonator.

By the above arrangement, the dielectric resonator unit according to the present invention can be controlled to change its resonance frequency by the control of a voltage applied to the piezoelectric frequency adjusting unit. Therefore, the dielectric resonator unit of the present invention may be employed in a voltage-controlled oscillator.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DESCRIPTION OF THE PREFERRED EMBODIMENTS

Figure 1A:
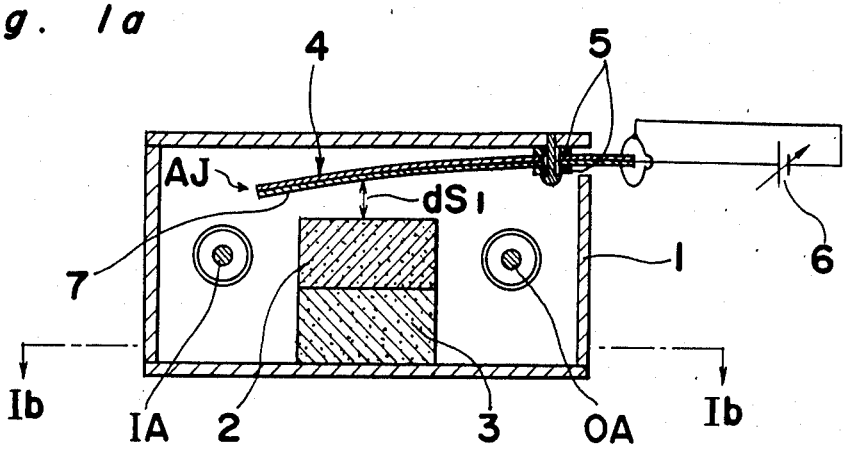
FIG. 1*a* is a cross-sectional view showing a dielectric resonator unit according to a first embodiment of the present invention.
Figure 1B:
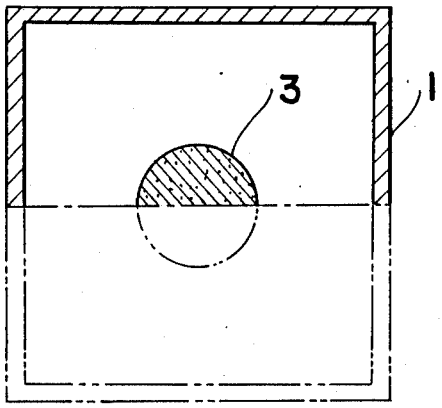
FIG. 1*b* is a cross-sectional view taken along a line Ib—Ib shown in FIG. 1*a;*
Figure 1C:
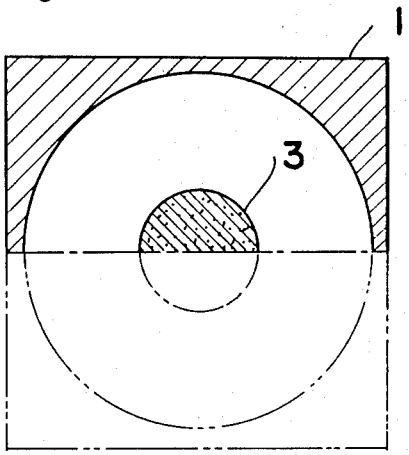
FIG. 1*c* is a view similar to FIG. 1*b*, but particularly showing a modification thereof.

Referring to FIG. 1, a dielectric resonator unit according to a first embodiment of the present invention is shown. In the drawing, a reference number 1 designates a casing made of an electrically conductive material. Inside the casing, a rectangular chamber, as shown in FIG. 1*b*, is defined. Instead of the rectangular chamber, a cylindrical chamber, such as shown in FIG. 1*c* may be formed. The inner dimensions of the chamber are so selected as to cut off all the signals imputted in the chamber. Therefore, casing 1 defines a both-end closed type cut off waveguide. In the chamber, a columnar support 3 made of, e.g., forsterite, is mounted approximately at the center of a bottom wall of the casing, and a (ZrSn) $TiO_4$ ceramic dielectric resonator 2 is further mounted on support 3. Resonator 2 has a cylindrical configuration and operates in the $TE_{01\delta}$ mode.

A piezoelectric frequency adjusting unit AJ is provided above and adjacent dielectric resonator 2. The piezoelectric frequency adjusting unit AJ according to the first embodiment is defined by an elongated piezoelectric unit, such as an elongated bimorph cell 4. One end portion of bimorph cell 4 is connected to the casing by a suitable securing means using a pair of electric insulators 5 for insulating the bimorph cell from the casing. The other end portion, i.e., a free end portion, of the bimorph cell is located adjacent the dielectric resonator so as to moves the free end portion towards or away from the dielectric resonator in a manner which will be described below.

Bimorph cell 4 is defined by two piezoelectric plates cemented together in such a way that an applied voltage causes one to expand and the other m to contract. Thus the cell bends in proportion to the applied voltage. Bimorph m cell 4 is externally connected to a variable power source 6 which can provide a DC voltage from zero volt to several tens of volts. In the example shown in FIG. 1, a space dS1 between bimorph cell 4 and resonator 2 is shortened as the voltage applied to the cell increases.

Bimorph cell 4 has three electric conductive films serving as exciting electrodes made of, e.g., Ag film 7. One electrode is sandwiched between the piezoelectric plates, and two others are deposited on the outer surface of the cell parallel to said one electrode. Therefore, the movement of the element 4 has the same effect as a metal screw that moves towards or away from a resonator as in the prior art resonator devices.

A signal is applied into the chamber from an imput antenna IA which extends across the chamber from one wall of the casing to the opposite wall, and the signal is taken out from the chamber by an output antenna OA which extends parallel to the input antenna. The input and output antenna are coupled to input and output connectors (not shown) in a known manner.

Figure 3:
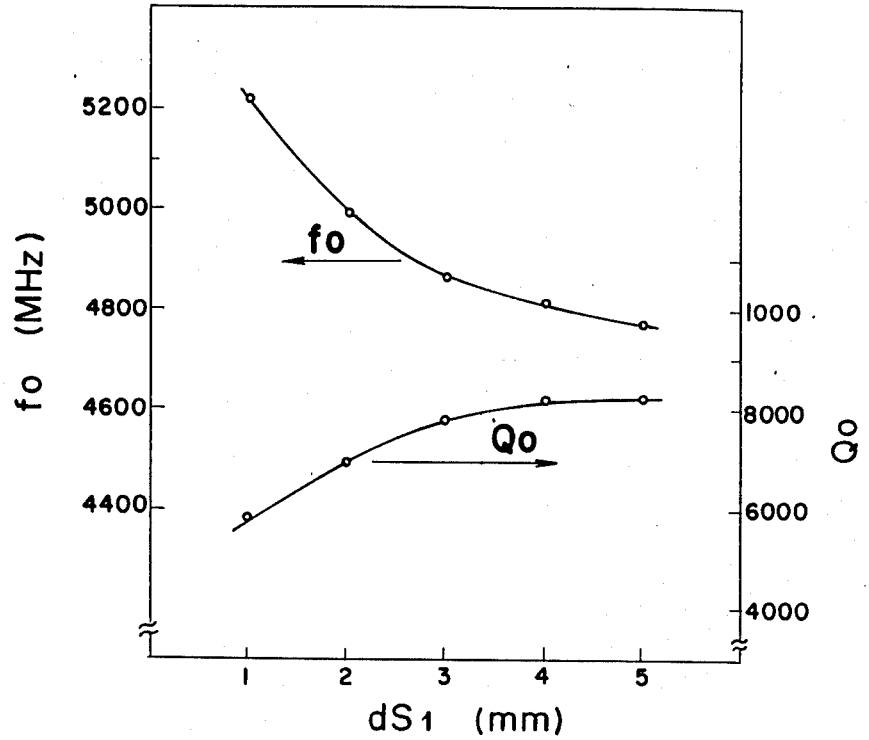
FIG. 3 is a graph showing a relationship between the resonance frequency and a space dS1 shown in FIG. 1*a*, and also a relationship between the no-load quality factor Q and the space dS1, obtained using the dielectric resonator unit of FIG. 1*a;*

Referring to FIG. 3, a graph is shown indicating the test results obtained using the dielectric resonator unit of the first embodiment shown in FIGS. 1*a* and 1*c* having the following specifications:

Chamber: diameter 33 mm; and height 15 mm;

Resonator 2: diameter 11 mm; height 5 mm; and relative dielectric constant 38,

Support 3: diameter 11 mm; height 5 mm; and relative dielectric constant 6.

In the graph, abscissa and ordinate represent, respectively, space dS1 and resonant frequency fo. The ordinate also represents the no-load quality factor Qo.

As clear from the graph, the non-load quality factor Qo changes very small with respect to dS1 when compared with a conventional device, whereas the resonance frequency $f_0$ changes at maximum 4% with respect to 1 mm change of dS1.

In the embodiment shown in FIG. 1*a*, the bimorph cell 4 bends by the application of DC voltage of several tens of volts. It is possible to make the bimorph cell 4 more sensitive to the voltage by adding further piezoelectric layers so that the control can be done with a smaller voltage levels.

Figure 2:
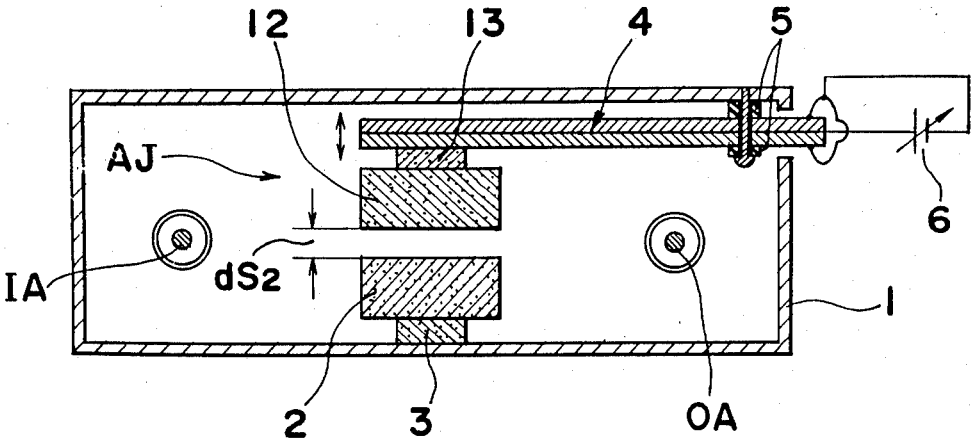
FIG. 2 is a cross-sectional view showing a dielectric resonator unit according to a second embodiment of the present invention.

Referring to FIG. 2, a dielectric resonator unit according to a second embodiment of the present invention is shown. When compared with the first embodiement, the dielectric resonator unit of the second embodiment further has another dielectric resonator 12 connected, through a suitable support 13, to the free end of elongated piezoelectric unit, i.e., bimorph cell 4 so that another dielectric resonator 12 moves, relatively to the voltage applied to the bimorph cell, towards or away from dielectric resonator 2 fixedly mounted in the casing. Thus, a space dS2 is provided between the resonator 2 and the resonator 12, and it will change with respect to the voltage applied to the bimorph cell. As a result, the resonance frequency in $TE_{01\delta}$ even-mode changes.

In the preferred embodiment, another dielectric resonator 12 is identical to resonator 2 not only in the configuration, but also in the relative dielectric constant. Also, support 13 has the same configuration and the same relative dielectric constant as those of support 3.

Figure 4:
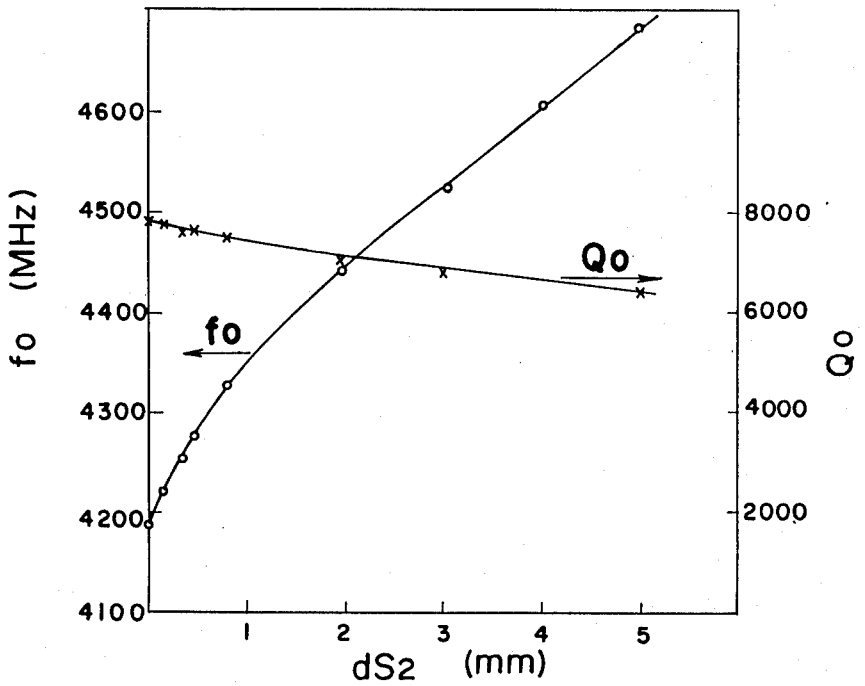
FIG. 4 is a graph showing a relationship between the resonance frequency and a space dS2 shown in FIG. 2, and also a relationship between the no-load quality factor Q and the space dS2, obtained using the dielectric resonator unit of FIG. 2.

Referring to FIG. 4, a graph is shown indicating the test results obtained using the dielectric resonator unit of the second embodiment shown in FIG. 2 having the following specifications:

Chamber: diameter 50 mm; and height 21 mm;

Resonator 2: diameter 11 mm; height 5 mm; and relative dielectric constant 38,

Resonator 12: same as resonator 2,

Support 3: diameter 5 mm; height 1.5 mm; and relative dielectric constant 6,

Support 13: same as support 3.

In the graph, abscissa and oridinate represent, respectively, space dS2 and resonant frequency fo in the $TE_{01\delta}$ even-mode. The ordinate also represents the no-load quality factor Qo.

Figure 5:
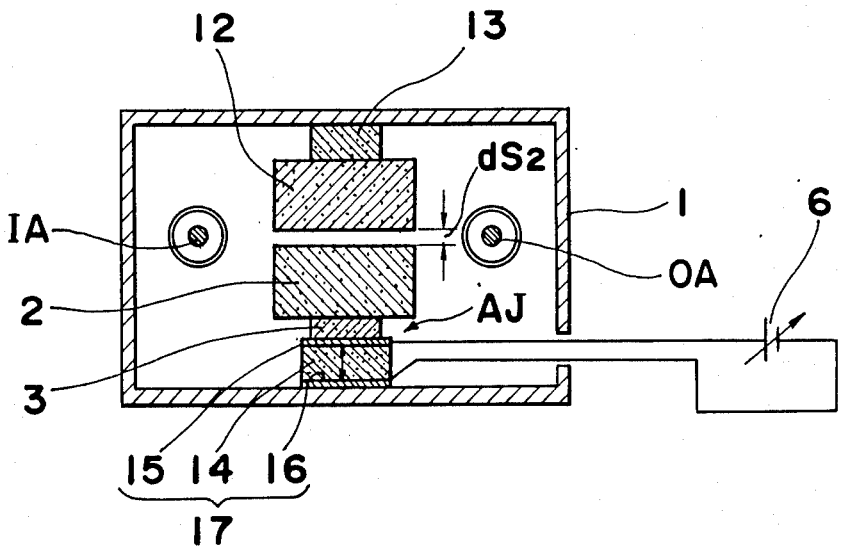
FIG. 5 is a cross-sectional view showing a dielectric resonator unit according to a third embodiment of the present invention.

Referring to FIG. 5, a dielectric resonator unit according to a third embodiment of the present invention is shown. The piezoelectric frequency adjusting unit AJ according to the third embodiment is defined by a piezoelectric element 17 comprising a piezoelectric body 14 and electrodes 15 and 16 deposited on the opposite flat faces of piezoelectric body 14. The face of piezoelectric element 17 provided with electrode 16 is connected to the bottom wall of the casing directly or through a suitable electric insulator, and the other face thereof provided with electrode 15 is connected to support 3. By the change of a DC voltage applied between electrodes 15 and 16, the thickness of the piezoelectric body 14 changes. Thus, dielectric body 2 moves, relatively to the voltage applied to the piezoelectric element 17, towards or away from dielectric resonator 12, which is fixedly mounted on the top wall of the casing through spacer 13. Thus, a space dS2 between resonators 2 and 12 change with respect to the voltage applied to the piezoelectric element 17.

Figure 6:
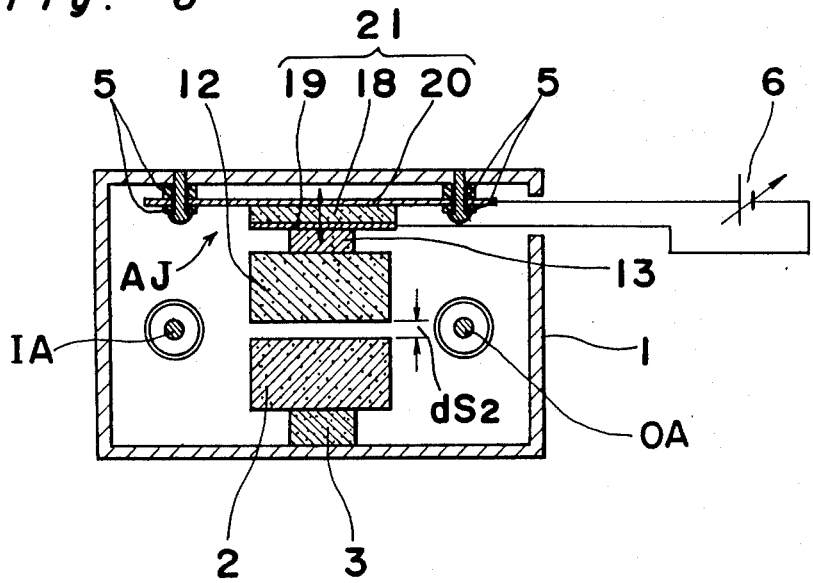
FIG. 6 is a cross-sectional view showing a dielectric resonator unit according to a fourth embodiment of the present invention.

Referring to FIG. 6, a dielectric resonator unit according to a fourth embodiment of the present invention is shown. The piezoelectric frequency adjusting unit AJ according to the fourth embodiment is defined by a piezoelectric element 21 comprising a piezoelectric body 18 an electrode 19 and a metal plate 20 having a size greater than the piezoelectric body 18. Piezoelectric element 21 is such as the one used in a piezoelectric buzzer, which is known in the art. The face of piezoelectric element 21 provided with metal plate 20 is connected to the top wall of the casing through a suitable spacer which also serves as an electric insulator, and the other face thereof provided with electrode 19 is connected to support 13. By the change of a DC voltage applied between electrode 19 and metal plate 20, the thickness of the piezoelectric body 18 changes. Thus, another dielectric resonator 12 moves, relatively to the voltage applied to the piezoelectric element 21, towards or away from dielectric resonator 2, which is fixedly mounted on the bottom wall of the casing through spacer 3. Thus, a space dS2 between resonators 2 and 12 change with respect to the voltage applied to the piezoelectric element 17.

Although the present invention has been fully described with reference to several preferred embodiments, many modifications and variations thereof will now be apparent to those skilled in the art, and the scope of the present invention is therefore to be limited not by the details of the preferred embodiments described above, but only by the terms of the appended claims.

What is claimed is:

1. A dielectric resonator device comprising:

a casing for defining a chamber therein;

a dielectric resonator provided in said chamber;

a piezoelectric frequency adjusting unit provided in said casing;

a portion of said piezoelectric frequency adjusting unit being located adjacent said dielectric resonator; and means for applying a voltage to said piezoelectric frequency adjusting unit;

said piezoelectric frequency adjusting unit being adapted to alter its shape by the voltage applied thereto so as to control a distance between said portion and said dielectric resonator, thereby controlling the resonance frequency of said dielectric resonator device.

2. A dielectric resonator device as claimed in claim 1, wherein said piezoelectric frequency adjusting unit comprises an elongated piezoelectric unit having a first end portion thereof connected to said casing, and a second end portion thereof located adjacent said dielectric resonator so as to moves said second end portion towards or away from said dielectric resonator relatively to a voltage applied to said elongated piezoelectric unit.

3. A dielectric resonator device as claimed in claim 2, wherein said elongated piezoelectric unit is a bimorph cell 4.

4. A dielectric resonator device as claimed in claim 2, further comprising another dielectric resonator mounted at said second end portion of said elongated piezoelectric unit so as to locate said another dielectric resonator adjacent said dielectric resonator.

5. A dielectric resonator device as claimed in claim 1, wherein said piezoelectric frequency adjusting unit comprises:

a piezoelectric element comprising a piezoelectric body, an electrode deposited on one face of said piezoelectric body and a metal plate deposited on another face of piezoelectric body, said metal plate being supported to said casing; and another dielectric resonator connected to said piezoelectric element, said another dielectric resonator being located adjacent said dielectric resonator.

6. A dielectric resonator device as claimed in claim 1, further comprising an input antenna means for providing signals into said chamber and an output antenna means for receiving signals in said chamber.

7. A dielectric resonator device comprising:

a casing for defining a chamber therein;

a piezoelectric frequency adjusting unit provided in said casing;

a dielectric resonator supported in said chamber through said piezoelectric frequency adjusting unit;

another dielectric resonator provided in said chamber;

a portion of said another dielectric resonator being located adjacent said dielectric resonator; and means for applying a voltage to said piezoelectric frequency adjusting unit;

said piezoelectric frequency adjusting unit being adapted to alter its shape by the voltage applied thereto so as to control a distance between said portion and said dielectric resonator, thereby controlling the resonance frequency of said dielectric resonator device.

* * * * *